US005644859A

United States Patent [19]

Hsu

[11] Patent Number: 5,644,859

[45] Date of Patent: Jul. 8, 1997

[54] BILLBOARD

[76] Inventor: Jessica Hsu, No. 18 Ting Juang Village, Hsiwn See Hsiang,, Chan Hua Hsien, Taiwan

[21] Appl. No.: 626,783

[22] Filed: Apr. 2, 1996

[51] Int. Cl.[6] ..... G09F 13/26

[52] U.S. Cl. ..... 40/545; 40/572; 40/624

[58] Field of Search ..... 40/545, 564, 572, 40/591, 592, 624, 747, 761, 763, 764

[56] References Cited

U.S. PATENT DOCUMENTS

| | | | |
|---|---|---|---|
| Re. 17,951 | 2/1931 | Brecht | 40/761 |
| 1,414,351 | 5/1922 | Fritz | 40/747 X |
| 2,186,982 | 1/1940 | Mansell | 40/545 |
| 2,237,750 | 4/1941 | Wamser | 40/545 |
| 2,540,271 | 2/1951 | Lytton | 40/545 |
| 2,825,799 | 3/1958 | Jullen | 40/592 X |
| 3,224,129 | 12/1965 | Green | 40/592 |
| 4,969,282 | 11/1990 | Eberhart | 40/545 |

*Primary Examiner*—Brian K. Green
*Attorney, Agent, or Firm*—Pro-Techtor International

[57] ABSTRACT

A billboard comprising a main body in which a lamp set is secured. The main body is rotatably fastened with a bottom seat and further fastened with two transparent pieces capable of enhancing the glittering effect of a neon lamp tube of the lamp set. The neon lamp tube can be bent to form a desired word or mark for a specific advertising purpose. The main body, to which the lamp set is attached, can be rotated in a desired direction in relation to the bottom seat.

2 Claims, 2 Drawing Sheets

BILLBOARD

BACKGROUND OF THE INVENTION

The present invention relates to a billboard for advertising purpose.

The conventional taxi billboard is generally made of an acrylic board and is provided therein with a lamp. A self-ahhesive paper, on which words intended for advertising goods or service are printed, is adhered to the billboard.

Such a conventional billboard as described above is defective in design in that the acrylic board has a rather limited light penetration rate so as to undenine the advertising effect of the billboard in view of the fact that the billboard can not be seen clearly at night. In addition, the design of the conventional billboard is devoid of versatility and is therefore rather limited in use. As a result, the conventional billboard is not economical. Moreover, the cost of the use of the conventional billboard is rather expensive in view of the fact that the billboard in its entirety must be replaced with a new one when the lamp of the billboard is damaged.

The taxi billboard is often use by the taxi driver to facilitate the consumers to identify the name of the taxi company to which the taxi driver is affiliated. The taxi billboard undermines the esthetic effect of the taxi.

SUMMARY OF THE INVENTION

It is therefore the primary objective of the present invention to provide a billboard comprismg a neon lamp or a group of neon lamp, which can be arranged to suit the specific advertising purpose.

It is another objective of the present invention to provide a billboard comprising a lamp tube which is replaceable. As a result, the billboard can be used again and again when the lamp tube is damaged.

It is still another objective of the present invention to provide a billboard comprising a neon lamp having various color illumination effects so as to enhance the advertising effect of the billboard.

It is still another objective of the present invention to provide a billboard which can be fastened to a taxi without undermining the esthetic effect of the taxi.

The foregoing objectives, features and funtions of the present invention will be more readily understood upon a thoughtful deliberation of the following detailed description of the present invention in conjunction with the accompanying drawings.

DETAILED DESCRIPTION OF THE INVENTION

Figure 1:
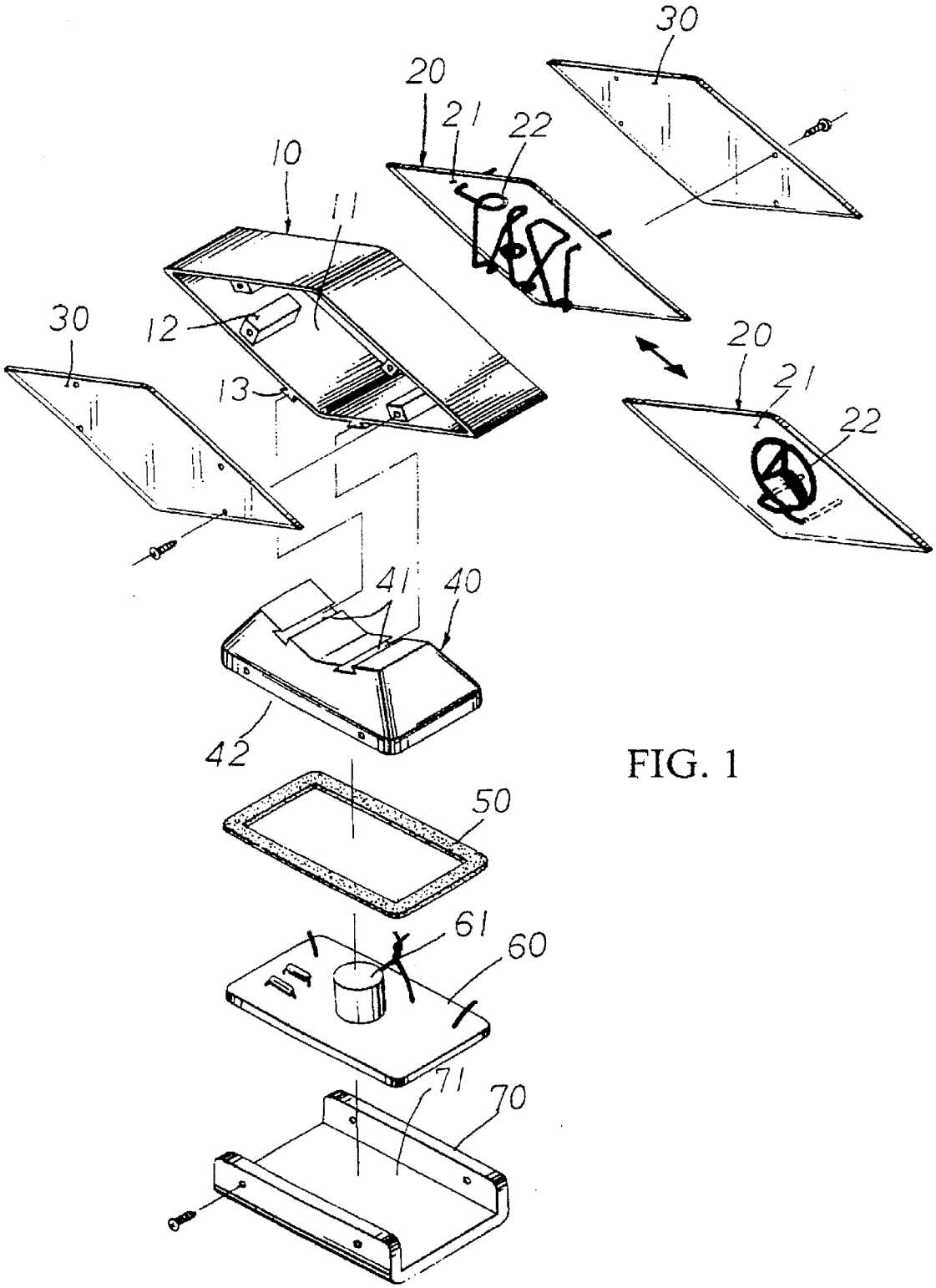
FIG. 1 shows an exploded view of the present invention.
Figure 2:
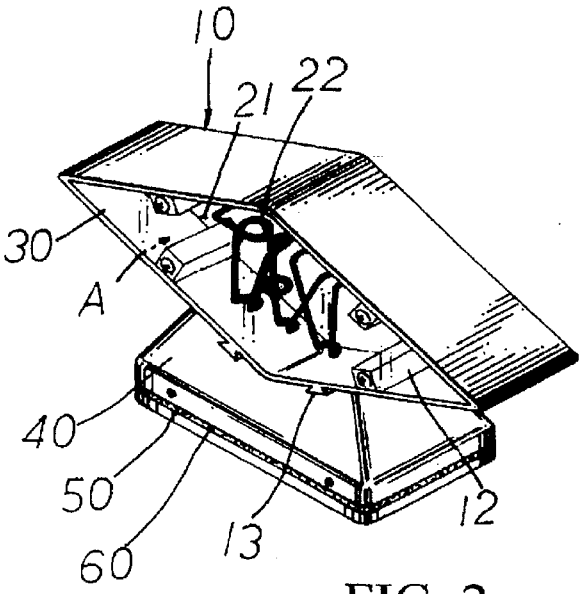
FIG. 2 shows a perspective view of the present invention in combination.

As shown in FIGS. 1 and 2, a billboard embodied in the present invention is composed of a main body 10, a retaining-type lamp set 20, two transparent pieces 30, a bottom seat 40, a waterproof plastic pad SO, a bottom board 60, and a base seat 70.

The main body 10 of a flat diamond construction is provided with a receiving space 11 and is flirther provided therein with a plurality of fastening blocks 12. Provided at the bottom of the main body 10 is a protruded strip 13 of a dovetail construction.

The retaining-lype lamp set 20 comprises a middle partition 21 to which a neon lamp 22 is fastened. The lamp set 20 is flistened in the receiving space 11 such that the fastening blocks 12 are divided into A and B divisions. The lamp set 20 is curved to form TAXI or other marks or store names, which are extended into the A division. The adjacent connecting and curved portion is painted in black so as to prevent the interference of the appearance of the normal patterns or words when the illumination takes place. The vertical sections are fastened with the middle partition 21 such that they extend into the B division 80 as to enable both A and B division to illuminate. Each of both chambers has a different marking appearance.

Figure 3:
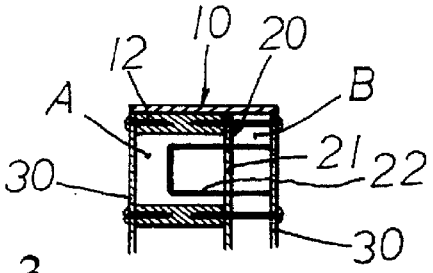
FIG. 3 shows a schematic view of the present invention which is locked and fastened.

The transparent pieces 30 are fastened securely with both sides of the main body 10 such that the transparent pieces 30 and the fastening blocks 12 are retained by a fastening or elastic hook retaining method, as shown in FIG. 3.

The bottom seat 40 of a square tapered body has a top end forming a V-shaped body along with the bottom of the main body 10. The bottom seat 40 is provided with a dove-tail slot 41 opposite to the dove-tail protruded strip 13 to facilitate the main body 10 to be joined therewith. The bottom seat 40 is provided in the interior thereof with a receiving slot 42 having an opening which faces downwards.

The waterproof plastic pad 50 has an empty center and is fastened securely with the bottom of the bottom seat 40.

The bottom board 60 is provideed with a current switching device 61 and a wire and is fastened securely with the bottom portion of the waterproof plastic pad 50 such that the current switching device 61 and the wire are received in the receiving slot 42 for supplying the power to the neon lamp 22.

The base seat 70 is fastened with the taxi body and is provided with a U-shaped slot 71 in which a sign is secured.

The illumination of the neon lamp 22 is made possible by the current switching device 61. The advertising effect is enhanced by the transparent pieces 30 capable of bringing about the glittering effect. In addition, the neon lamp 22 is brighter than the ordinary light bulb and is therefore capable of drawing the people's attention.

The most important advantage of the present invention is that the lamp set 20 is fastened with the transparent pieces 30 by means of the fastening blocks 12. As a result, the lamp set 20 can be set up in any combination to suit the need of the user. For example, the neon lamp tube 22 can be so bent so as to form a word "TAXI" for use by a taxi driver, as shown in FIG. 1. Similarly, the neon lamp tube 22 can be bent to form various store names or marks for use by various business persons. In other hand, the billboard of the present invention is relatively versatile as well as economical in view of the fact that the lamp set 20 is damaged or burned out, and that the billboard of the present invention can be used again and again.

Figure 4:
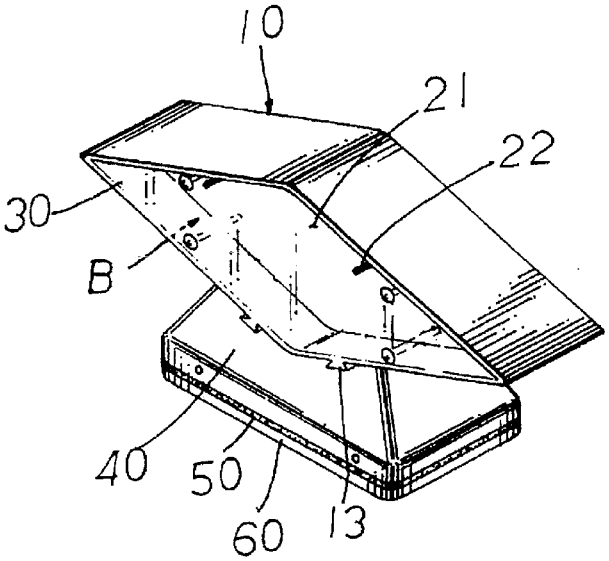
FIG. 4 shows another perspective view of the present invention in combination.

As shown in FIG. 2, the neon lamp tube 22 is bent to form the word "TAXI" so as to enable the transparent piece 30 covering the A division to have a see-through effect for indicating the type of the use of the present invention. In the meantime, the transprent piece 30 covering the B division can be used to show the name of the company to which the taxi belongs or other marks for specific advertising purpses, as shown in FIG. 4. In addition the color of the neon lamp tube 22 can be coordinated with the color of the taxi so as to enhance the advertising effect. Moreover, the neon lamp tube 22 is fastened with the bottom base 40 by the fastening means of the dovetail construction. As a result, the main body 10 and the neon lamp tube 22 can be turned in a desired direction.

The embodiment of the present invention described above is to be regarded in all respects as being merely illustative and not restrictive. Accordingly, the present invention may be embodicci in other specific forms without deviating from the spirit thereof. The present invention is therefore to be limited only by the scopes of the following appended claims.

What is claimed is:

1. A billboard comprising:

a main body provided with a receiving space having a plurality of fastening blocks and a dovetailed protruding strip at a bottom side thereof;

a replaceable lamp set comprising a middle partition with a neon lamp tube fastened thereto, said lamp set is secured in said receiving space of said main body such that an A and a B division are formed, said neon lamp tube is shaped to form a symbol chosen by a user, said symbol extends into said A division, said neon lamp tube is fastened to said middle partition and extends into said B division so as to enable said A division and said B division to be illuminated;

two transparent pieces fastened to said main body such that said transparent pieces and said fastening blocks of said main body are retained by a fastening means;

a bottom seat having a top surface with a shape corresponding to a shape of said bottom side of said main body, said bottom seat includes a slot to receive said dovetailed protruding strip of said main body to secure said main body to said bottom seat, a lower surface of said bottom seat includes a receiving slot, a waterproof plastic pad having an open center and fastened to said bottom seat;

a bottom board provided with a current switching device and a wire, said bottom board is fastened to said waterproof plastic pad such that said current switching device and said wire are received in said receiving slot of said bottom seat to provide said neon lamp tube with power; and a base seat with a U-shaped slot, said U-shaped slot receives said bottom board, said waterproof plastic pad, and said bottom seat.

2. The billboard as defined in claim 1, wherein:

said neon lamp tube has a color that is coordinated with a color of a taxi body.

* * * * *